US005181576A

United States Patent [19]

Askew et al.

[11] Patent Number: 5,181,576

[45] Date of Patent: Jan. 26, 1993

[54] DOWNHOLE ADJUSTABLE STABILIZER

[75] Inventors: Warren E. Askew; Alan Eddison, both of Houston, Tex.

[73] Assignee: Anadrill, Inc., Sugar Land, Tex.

[21] Appl. No.: 737,637

[22] Filed: Jul. 30, 1991

Related U.S. Application Data

[63] Continuation-in-part of Ser. No. 649,777, Feb. 1, 1991, abandoned.

[51] Int. Cl.[5] ..... E21B 7/04

[52] U.S. Cl. ..... 175/61; 175/73; 175/76; 175/325.3

[58] Field of Search ..... 175/61, 73, 74, 76, 175/256, 325, 325.3, 325.4

[56] References Cited

U.S. PATENT DOCUMENTS

| | | | |
|---|---|---|---|
| 2,194,267 | 3/1940 | Brock et al. . | |
| 2,876,992 | 3/1959 | Lindsay . | |
| 3,196,959 | 7/1965 | Kammerer . | |
| 3,561,549 | 2/1971 | Garrison | 175/76 |
| 3,880,246 | 4/1975 | Farris | 175/61 |
| 3,938,853 | 2/1976 | Jurgens et al. | 166/241 X |
| 4,015,673 | 4/1977 | Craig, Jr. et al. | 175/61 |
| 4,076,084 | 2/1978 | Tighe | 175/73 |
| 4,394,881 | 7/1983 | Shirley | 175/76 |
| 4,416,339 | 11/1983 | Baker et al. | 175/61 |
| 4,471,843 | 9/1984 | Jones, Jr. et al. | 175/73 |
| 4,560,013 | 12/1985 | Beimgraben | 175/73 |
| 4,635,736 | 1/1987 | Shirley | 175/76 |
| 4,655,289 | 4/1987 | Schoeffler | 166/320 |
| 4,729,438 | 3/1988 | Walker et al. | 175/76 |
| 4,842,082 | 6/1989 | Springer | 175/279 |
| 4,848,490 | 7/1989 | Anderson | 175/323 |
| 4,854,403 | 8/1989 | Ostertag et al. | 175/325 |
| 4,877,092 | 10/1989 | Helm et al. | 175/74 |
| 5,050,692 | 9/1991 | Beimgraben | 175/61 |

OTHER PUBLICATIONS

Boulet, J. G., "THD System/Telepilote/Varistab", SMF International Article, Ocean Industry/OTC 1986.

12 θ" Varistab Instruction Manual (1989).

"Horizontal Systems Growing More Specialized", Directional Control Technologies, Offshore, pp. 36-43, Oct. 1989.

*Primary Examiner*—William P. Neuder

*Attorney, Agent, or Firm*—John J. Ryberg; David L. Moseley

[57] ABSTRACT

In accordance with illustrative embodiments of this invention, a downhole adjustable stabilizer includes a sleeve having outwardly extending blades and mounted for limited rotation on a mandrel, vertically aligned sets of radially movable buttons mounted in bores in the blades, and longitudinal flats on the outer periphery of the mandrel that when radially aligned with the respective sets of buttons allows them to shift inward to positions where the stabilizer becomes undergage and can be tilted in the borehole. Some spring loaded buttons drag against the borehole wall to provide frictional restraint against rotation of the housing. The blades can each have an inclined side surface that causes the sleeve to be rotated to its position relative to the mandrel where the sets of buttons are retracted as the stabilizer slides downward in the borehole. In another embodiment a hydraulic delay is provided which restrains relative rotation in the direction which cause the buttons to extend to their full gauge diameter.

40 Claims, 5 Drawing Sheets

DOWNHOLE ADJUSTABLE STABILIZER

CROSS-REFERENCE TO RELATED APPLICATION

This application is a continuation-in-part of application Ser. No. 649,777 filed Feb. 1, 1991.

FIELD OF THE INVENTION

This invention relates generally to a stabilizer that is used to center a portion of a drill string in a borehole, and particularly to a new and improved adjustable stabilizer that can be changed downhole between one condition where it centers the drill string in the borehole and another condition where it can be tilted with respect to the longitudinal axis of the borehole.

BACKGROUND OF THE INVENTION

It is common to use one or more stabilizers in a drill string to keep the string centered and thereby control the inclination of the hole as the bit drills into the earth. A typical stabilizer includes a tubular housing having radially extending blades that is threaded into the pipe. The outer faces of the blades engage the wall of the bore to center the drill string. Where a pair of properly spaced, full-gage stabilizers is used and one is located near the bit, drilling generally will proceed straight ahead. If a near-bit stabilizer is not used and the bore is inclined with respect to vertical, the bit will tend to drill along a path that curves downward due the pendulum effect of the weight of that length of drill pipe which extends downward beyond the uphole stabilizer. If an undergage stabilizer is used uphole in combination with a full-gage stabilizer near the bit, the sag in the drill string at the uphole stabilizer tends to cause the bit to drill along a path that curves upward. Thus to some extent the use and axial positioning of stabilizers can be employed to control the inclination of the borehold in directionally drilled wells.

Another way to change the inclination of a borehole is to use a so-called "bent sub" that can be positioned in the string, for example, above a downhole drilling motor or between the motor and the bearing assembly just above the bit. The conventional bent sub is a length of pipe which has a lower portion formed at an angle to the upper portion thereof. With the sub providing a bend in the pipe, the bit will tend to drill along a path that curves in a plane which contains the two sides or axes of the bent angle, below the bend point. The bit can be steered to some extent to the right or to the left by orienting the plane of the bend with respect to vertical by manipulation of the drill pipe at the surface. Straight-ahead drilling can be resumed by superimposing drill pipe rotation over the rotation of the motor. Although the drill bit will wobble as the bend point orbits about the axis of the borehole, the overall tendency of the bit is to drill a straight hole. Precise control over the borehole inclination can be achieved only where a near-bit stabilizer is used to keep the bit from wandering as it drills, for example, through a dipped bedding plane between two rock strata having different characteristics.

However, the use of a typical stabilizer near the bit impedes the establishment of a bend angle as described above because it resists tilting of the rotation axis of the bit. The blades of the stabilizer engage the wall of the hole for a considerable length that is full gage, and of course the rock resists any tilting of the assembly. This can reduce the effectiveness of using a bend angle to change the course of the borehole in a predictable manner. Yet a near-bit stabilizer is considered to be essential for optimum directional control.

An uphole stabilizer that has been proposed for directional drilling is disclosed in Anderson U.S. Pat. No. 4,848,490 issued Jul. 18, 1989. This device uses spiral blades that carry buttons which can be extended from a minimum to a maximum diameter in response to downward movement of a mandrel within a housing that forms the blades. A spring loaded mechanical detent is used to prevent downward relative movement until a predetermined axial compressive load is applied. However this device is not designed for use as a near-bit motor stabilizer, but rather as an uphole stabilizer which centers the drill string when the buttons are extended, and which allows the string to sag when the buttons are retracted. As disclosed, the stabilizer of the '490 patent does not have many of the features of the present invention. For example, control over the stabilizer requires the application of a certain level of axial compressive force, which can be inadvertently applied during normal drilling operations, or which may not reach the stabilizer at all in a highly deviated well due to wall friction on the pipe. Moveover, a mechanical detent necessarily involves high friction forces, so that tripping can occur at unpredictable levels, particularly as inevitable wear takes place. Rotation of the housing relative to the mandrel cannot occur, so that the stabilizer can not automatically resume its maximum diameter position when the drill string is rotated. Other distinctions also will becomes apparent.

Other problems also occur in providing near-bit stabilization that are not appreciated by the above-mentioned patent. For example, during sliding drilling, the lower portion of the drill string including the motor housing can undergo torsional oscillations as the drill string winds up and unwinds due to variations in weight-on-bit, changes in formation characteristics, strengths of the rocks, bit wear, type of bit, and other variables. As used herein, the term "sliding" drilling means drilling a borehole using only a downhole motor. The drill string is not turned during this type of drilling, but simply slides downward as the borehole is deepened by the bit. Such torsional oscillations can reduce the effectiveness of a variable diameter near bit stabilizer unless precautions are taken to ensure that during sliding drilling the stabilizer remains in its undergage condition even in the presence of such oscillations.

An object of this invention is to provide a new and improved near-bit stabilizer that automatically assumes an undergage condition when a bend angle is being used to directinally drill a borehole.

Another object of the present invention is to provide a new and improved stabilizer that can be operated downhole in a manner such that normally retracted, laterally shiftable members are extended to a full gage diameter in response to rotation of the pipe string.

Yet another object of the present invention is to provide a new and improved downhole adjustable stabilizer having wall engaging means that extend to the full gage of the hole in one mode of operation, and which retract to a lesser diameter when a bend angle is present in the drill string above the stabilizer to enable the rotation axis of the bit to tilt.

Still another object of the present invention is to provide a new and improved adjustable near-bit stabilizer that will remain undergage during sliding drilling in the presence of drill string torsional oscillations.

SUMMARY OF THE INVENTION

These and other objects are attained in accordance with the concepts of the present invention through the provision of a stabilizer apparatus that includes a tubular mandrel having means at its upper and lower ends for coupling it in a drill string immediately above the bit. If desired, the mandrel can house the thrust and radial bearings for the shaft that turns the drill bit. A tubular housing or sleeve is mounted on the mandrel for limited relative rotation and is formed with outwardly directed blades, each of which carries a vertically arranged set or series of pistons or buttons that can move between inner and outer positions. The rear faces of some of the pistons normally engage flat surfaces of the mandrel in a manner such that those pistons are retracted. Other pistons can be used which are biased outward at all times to provide friction drag forces against the well bore wall. The mandrel is provided with cam surfaces adjacent the flat so that when the housing is turned relative to the mandrel in one rotational direction, the pistons are extended to a full gage diameter. When the housing turns relative to the mandrel in the opposite rotational direction, the pistons can shift inward to an undergage diameter. When the pistons are retracted the housing and blades can be tilted to some extent within the borehole so as not to impede the establishment and use of a bend angle in the drilling process. During downward movement, the housing is automatically rotated to and held in its rotational orientation where the pistons are retracted. In another embodiment of the present invention, a hydraulic delay against relative rotation in one direction is provided so that during sliding drilling the pistons will remain undergage even though the lower portion of the drilling string undergoes torsional oscillations as the bit drills through the rocks.

BRIEF DESCRIPTION OF THE DRAWINGS

The present invention has other objects, features and advantages which will become more clearly apparent in connection with the following detailed description of preferred embodiments, taken in conjunction with the appended drawings in which.

DETAILED DESCRIPTION OF PREFERRED EMBODIMENTS

Figure 1:
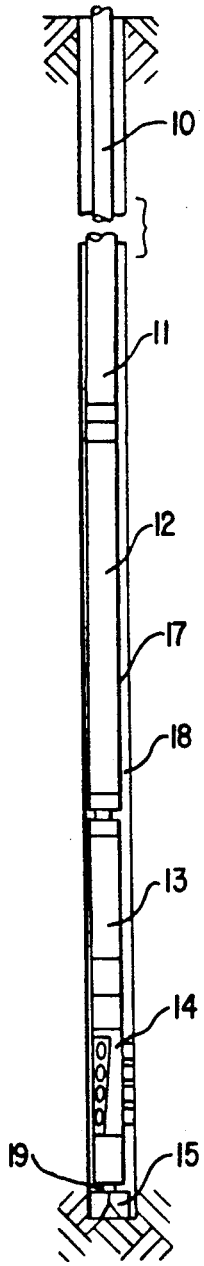
FIG. 1 is a schematic view of a well bore having a drill string including a downhole motor, a downhole adjustable bent housing, the adjustable near-bit stabilizer of the present invention, and a drill bit disposed therein.

Referring initially to FIG. 1, a drill string including a section of drill pipe 10 and a length of drill collars 11 is shown positioned in a well bore 17. A downhole motor power section 12 is attached to the lower end of the collars 11, and the lower end of the power section 12 is connected to a bent housing assembly 13. A near bit stabilizer and bearing assembly 14 that is constructed in accordance with an embodiment of this invention is attached below the bent housing assembly 13. A spindle 19 that rotates the rock bit 15 in order to drill the borehole extends out the lower end of the stabilizer 14. Drilling fluids that are circulating by mud pumps at the surface down the pipe 10 and the collars 11 cause the rotor of the power section 12 to spin and such rotation is coupled to the spindle 19 by a drive shaft having cardan-type universal joints at each end. The drilling fluids are exhausted through nozzles, or jets, in the bit 15, and circulate upward to the surface through the annulus 18. As disclosed and claimed in copending U.S. application Ser. No. 649,107, filed concurrently herewith and assigned to the assignee of this invention and incorporated herein by reference, the bent housing assembly 13 can be adjusted downhole from one condition where the bit 15 will drill straight ahead, to another condition that produces a bend angle in the motor housing so that the bit will tend to drill along a curved path. The assembly 13 can be repositioned in its original configuration for straight-ahead drilling as desired. Although other tools could be used to establish a bend angle either in the housing of the motor 12 or in the drill string thereabove, the apparatus disclosed in said application is preferred.

Figure 2:
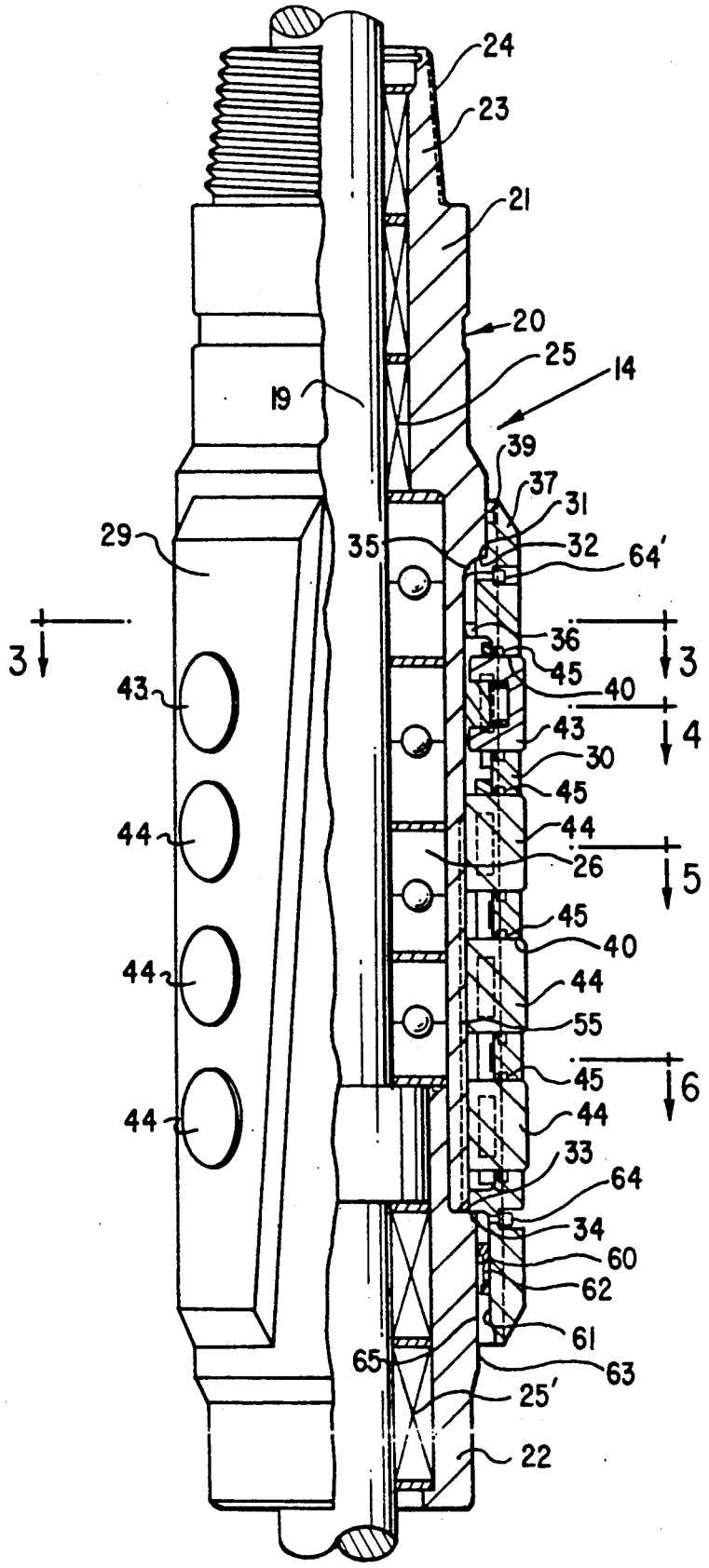
FIG. 2 is a longitudinal sectional view, with portions in side elevation, of the present invention.

As shown in FIG. 2, one embodiment of the stabilizer 14 includes a mandrel assembly 20 having an upper portion 21 and a lower portion 22. The upper portion 21 has a pin 23 with threads 24 which can be connected to the housing of the assembly 13 thereabove. Upper and lower radial bearing assemblies shown symbolically as 25 and 25', and a stack of thrust bearings 26, can be mounted inside the mandrel portions 21 and 22 as shown. These bearings function to rotationally support the spindle 19 which has the bit 15 mounted on its lower end. A generally tubular housing 30 is mounted on the mandrel 20, and is restrained against vertical relative movement by the engagement of shoulders 31, 32 near the upper end of the housing 30, and by shoulders 33, 34 near the lower end thereof.

Figure 3:
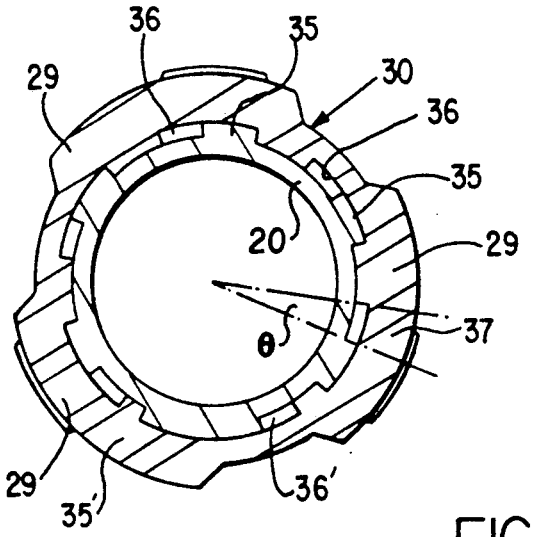
FIG. 3 is a full cross-section on line 3—3 of FIG. 2.

Splines 35 on the mandrel portion 21 mesh with spline grooves 36 on the upper housing portion 37 to limit relative rotation. However as shown in FIG. 3, each of the grooves 36 is wider than its companion spline 35 so that a certain degree of relative rotation can occur. In the embodiment shown, the housing 30 can rotate clockwise relative to the mandrel 20 through the angle $\theta$. One of the splines 35' and its groove 36' are considerably wider than the others to ensure that the mandrel 20 can be mounted in the housing 30 in only one relative position. A suitable seal ring 39 (FIG. 2) prevents fluid leakage.

Figure 4:
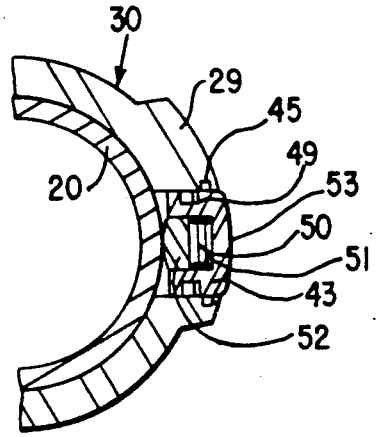
FIG. 4–7 are right side only sections taken on lines 4—4, 5—5, 6—6 and 7—7 of FIG. 2.
Figure 5:
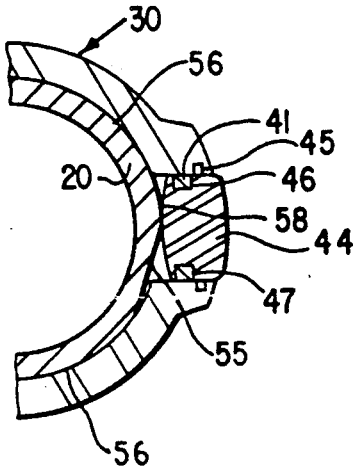
Figure 6:
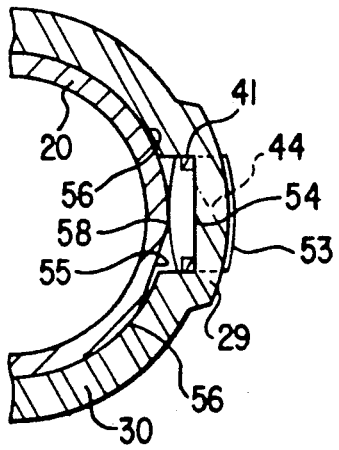
Figure 8:
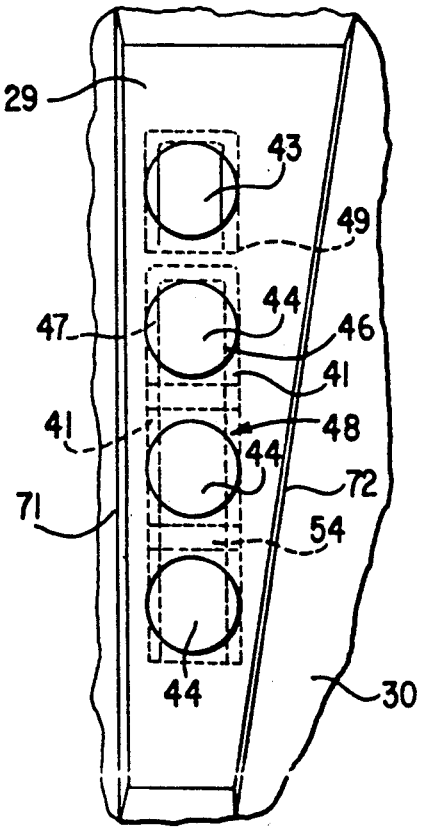
FIG. 8 is a developed, external plan view of a blade having a series of the stabilizer pistons therein.

The housing 30 is provided with three outwardly extending blades 29 at equal angular spacings. The outer face of each blade 29 is wear-hardened, and lies on a diameter that is slightly undergage with respect to the diameter of the borehole 17 that is drilled by the bit 15. Each blade 29 has a set of vertically aligned, radially extending bores 40. Received in each set of bores, from top to bottom, is a drag piston 43 and three stabilizer pistons 44. Of course other combinations and numbers of pistons could be used. Each of the pistons 43, 44 is sealed by a suitable seal ring 45 to keep drilling mud out of the inside. As best shown in FIGS. 5 and 8, the opposite sides of each of the pistons 44 have longitudinal slots 46, 47 milled therein which receive the legs 41 of a generally U-shaped retainer member 48 which couples these pistons together so that they move in unison, and which limits their outward movement. Another shorter U-shaped member 49 retains and limits outward movement of the drag pistons 43 as shown in FIGS. 4 and 8. Each of the drag pistons 43 has a rearwardly opening bore 50 that receives a coil spring 51 and a spacer 52. The spring 51 urges the piston 43 outward so that its outer face 53, which is arcuate and preferably also wear hardened, engages the well bore wall to provide some frictional resistance to rotational and longitudinal movement of the housing 30. As shown in FIG. 6, a transverse leaf spring 54 having an outwardly concave mid-portion is mounted so that its opposite end portions engage and are attached to outer surfaces of the legs 41 of the retainer member 48, while its center portion engages an inner wall surface of the blade 29 between adjacent piston bores 40. The leaf spring 54 apply inward forces to the retainer 48, which cause the rear faces of the pistons 44 to ride against the outer peripheral surfaces of the mandrel 20.

Figure 7:
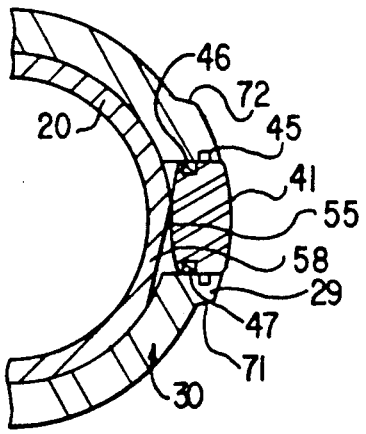

As shown in FIGS. 5–7, flat surfaces 55 are formed on the mandrel portion 21 so as to extend longitudinally throughout the region behind each set of the stabilizer pistons 44. The longitudinal centerlines of the flats 55 are located on 120° spacings and are orientated relative to the splines 35, the grooves 36 and the angle $\theta$ such that the flats are located behind the respective sets of pistons 44 in one angular relative position of the mandrel and housing, and are not behind them in another angular relative position. The side surfaces which join the flats 55 to the cylindrical outer peripheral surfaces 56 of the mandrel 20 are smoothly rounded as shown to provide transitions to such surfaces. When the surfaces 56 are behind the stabilizer pistons 44, these pistons are held in their outer positions. However, when the sleeve 30 rotates clockwise relative to the mandrel 20, as viewed from above, the flats 55 are positioned behind the pistons 44 as shown in FIG. 7. Thus the pistons 44 are shifted inward by the leaf springs 54 as their rear faces 58, which preferably have a cylindrical shape, engage the faces of the flats 55. When the three sets of pistons 44 are in on the flats 55 so that the o.d. of the assembly is undergage, the stabilizer assembly 14 is substantially loosened in the borehole and can be cocked or tilted to some extent.

To lower section 60 of the housing 30 has an increased inner diameter to provide an annular wall 61. A compensating piston 62 is movably arranged between the wall 61 and the external upset surface 63 of the mandrel portion 22. The internal spaces between the mandrel portions 21 and 22 and the housing 30 are filled with a suitable lubricating oil via a fill port 64 as air is bled out through an upper port 64'. A snap ring 65 limits downward movement of the compensating piston 62, and the shoulder 34 limits downward travel of the housing or sleeve 30. The piston 62 can move longitudinally to provide compensation for changes in the volume of the oil chamber during radial piston movement, as well as providing compensation for changes in hydrostatic pressure and temperature.

As shown in FIGS. 2 and 8, each set of the pistons 43 and 44 is mounted in a blade 29 having a longitudinal wall 71 on one side and an opposite sidewall 72 that inclines downward in a clockwise direction on a helix. As the stabilizer assembly 14 moves downward during sliding drilling the housing 30 tends to rotate clockwise, as viewed from above, relative to the mandrel 20 due to lateral forces applied by the rock to the outer edge of an inclined side wall 72. In response to such forces the housing 30 rotates clockwise through the angle $\theta$ shown in FIG. 3, until the sidewalls of the grooves 36 engage the sidewalls of the splines 36. In this rotational orientation, the pistons 44 are radially positioned opposite the mandrel flats 55 and thus are retracted.

When the motor 12 is placed in operation by starting up the mud pumps at the surface, the drilling string 10, 11 "winds up" to some extent in reaction to the resistance afforded by the bottomhole rock to rotation of the bit 15. One might expect that the degree of wind up, which has its maximum amplitude in the vicinity of the housing of the drilling motor 12, would remain substantially constant. However, in practice this is not always the case. In fact the drill string often undergoes back and forth or oscillating rotations in opposite hand directions, much like the escapement wheel of a clock, for the various reasons noted above. Such rotational oscillations are transmitted by the bent housing 13 to the mandrel 20 of the stabilizer 14, and can cause the buttons 44 to tend to go in and out, that is, alternate between their full and undergage diameters. To insure that the stabilizer buttons will remain retracted or undergage during sliding drilling, the embodiment of the invention shown in FIGS. 9 and 10 can be employed.

Here the stabilizer assembly 100 includes a mandrel 101 that houses thrust and radial bearings (not shown) for the spindle 19 that is attached to the drill bit 15, such bearings and the way in which they are mounted being substantially the same as shown in FIG. 2. The upper end portion 102 of the mandrel 101 is threaded at 103 to the lower end of the downhole adjustable bent housing 13. A sleeve member 104 is carried on the outside of the mandrel 101 and is formed with a plurality of longitudinally extending, outwardly directed blades 105. Each of the blades 105 has a vertical row of axially spaced, radially extending bores 106, and each of these bores receives a cylindrical button 107. The structure of each of the buttons 107, how the vertical rows of buttons are ganged together for inward and outward, and how they are each biased inward toward the undergage diameter is described above respecting the buttons 44 of the previous embodiment 14 and thus need not be described in detail again. As shown in FIGS. 6 and 7 with respect to the previous embodiment, the mandrel 101 has longitudinally extending flat surfaces 55 that allow the buttons 107 to shift inward to their undergage diameter when the mandrel rotates counterclockwise, as viewed from above, relative to the sleeve member 104, and cylindrical outer surfaces 56 that position the buttons in their extended or full gauge diameters when the mandrel 101 is rotated clockwise relative to the sleeve member. The outwardly biased drag buttons 43 of the previous embodiment need not be used in this embodiment, although they could be. It also should be noted that both of the sidewalls 108, 108' of each blade 105 extend axially, rather than one side wall being inclined as previously described.

The upper end portion 110 of the sleeve member 104 abuts against an outwardly extending shoulder 105 on the mandrel 101 to limit upward relative movement of the sleeve member, and an adapter 111 that is screwed into the bottom of the mandrel 101 provides an upwardly facing shoulder 112 against which a stop sleeve 113 is mounted. The upper face of the stop sleeve 113 engages a downwardly facing shoulder 114 on the lower section 115 of the sleeve member 104 to prevent downward relative movement of the sleeve member. As in the previous embodiment, a floating piston ring 116 transmits ambient pressures to an oil that fills all the internal spaces between the mandrel 101 and the sleeve member 104.

To rotationally couple the sleeve member 104 to the mandrel 101 in a manner such that the buttons 107 remain retracted during sliding drilling, even in the presence of rotational oscillations of the drill string 10, 11, the upper section 110 of the sleeve member 104 has its inner walls 120 laterally spaced from the outer walls 121 of the mandrel 101 to provide an internal annular chamber 122. As shown in clearer detail in FIG. 10, a hydraulically operable delay mechanism in the form of a sleeve piston 123 is arranged for axial movement in the chamber 122, and carries seal rings 124, 125 which prevent any fluid leakage past the inner and outer surfaces of the upper portion thereof. A metering passage 129, 129' extends between chamber regions 126, 127 respectively above and below the sleeve piston 123. The upper end of the chamber region 126 is sealed by rings 128, and a port 130 and a plug 131 are provided to enable the chamber to be filled with a suitable volume of hydraulic oil. A flow restrictor 132 is positioned in the passage 129 to meter downward flow of oil in a precise manner, and thus provide a selected time delay to upward movement of the sleeve piston 123 within the chamber 122. The opposite side of the sleeve piston 123 is provided with another passage 129' (FIG. 9) in which a downwardly closing check valve 145 is located. The check valve 145 has a low opening pressure, for example in the range of about 2–5 psi differential.

The lower portion 134 of the sleeve piston 123 has external splines 139 that mesh with internal slines 135 on the upper portion 110 of the sleeve member 104 so that the sleeve piston cannot rotate relative thereto. A plurality of circumferentially spaced lugs 136 project inwardly at the bottom of the sleeve piston 123 into a companion plurality of channels 137 that are formed in the outer periphery of the mandrel 101. As shown in developed plan view in FIG. 11, each of the channels 137 has a helically inclined upper segment 138 that opens downward into an arcuate lower segment 140. The upper channel segments 138 are only slightly wider than the lugs 136, which are polygon in shape, as shown, so that they fit snugly therein during relative rotation. The lower segment 140 of each channel 137 receives an inwardly projecting rib 141 on the sleeve member 104 that has a substantially lesser arcuate dimension than the corresponding dimension of the channel segment 140. Thus the sleeve member 104 can rotate through a limited angle in a clockwise direction relative to the mandrel 101, as viewed from above, until the ribs 141 abut against the side walls 142 of the channel segments 140 as shown in dash lines in FIG. 11. During such relative rotation the lugs 136 on the sleeve piston 123 are cammed downward in the inclined segments 138 to the position shown in dash lines, which advances the sleeve piston 123 downward in the chamber 122. During such downward movement, reduced pressure is generated in the upper chamber region 126 which causes oil in the lower region 127 to flow upward through the check valve 145 into the upper region. The low opening pressure of the check valve 145 enables the sleeve piston 123 to move downward without appreciable restraint. When the ribs 141 abut the side walls 142 of the lower channel segment 140, they will have rotated through an angle of which can be about 16°. In this position of the ribs 141, the sleeve piston 123 will have moved to the limit of its downward travel. Relative rotation of the sleeve member 104 in the clockwise direction is that direction which causes retraction of the buttons 107 to their undergage positions.

When the mandrel 101 rotates clockwise relative to the sleeve member 104, the lugs 136 on the sleeve piston 123 are cammed in the upward direction by the inclined segments 138 of the channels 137 and thereby attempt to drive the sleeve piston 123 upwardly within the chamber 122. Upward force on the sleeve piston 123 generates high pressure in the oil in the upper chamber region 126, which tends to cause the oil to flow downward in the passage 129 via the flow restrictor 132. The check valve 145 seats to prevent downward flow through the passage 129'. The restricted flow of oil through the passage 129 and the restrictor 132 retards or restrains upward movement of the sleeve piston 123, and restrains relative rotation of the sleeve member 104 in the counterclockwise direction, which is the direction that causes extension of the buttons 107 to their full-gauge diameter.

If the torsional oscillations of the drill string 10, 11 have an amplitude that does not cause the ribs 141 to engage the sidewalls 142 initially, the delay mechanism will nevertheless cause such engagement to occur after several oscillations. The first time the mandrel 101 rotates counterclockwise under these circumstances, the lugs 136 will move partially down the inclined segments 138 to an intermediate position, and then when the mandrel rotates clockwise the hydraulic delay will cause the sleeve member 104 to rotate with it. On the next or a subsequent counterclockwise rotation of the mandrel 101, the lugs 136 will abut the sidewalls 142 and be hydraulically restrained by the delay thereagainst. Thus the buttons 107 will shortly come in to their undergage diameter as sliding drilling is commenced.

OPERATION

The parts of each embodiment are assembled as shown in the drawings to provide a combination bearing assembly and near-bit stabilizer 14 or 100 that is connected in the drill string immediately above the bit 15 and below the housing 13 of the downhole motor 12. In the embodiment shown in FIG. 2, one or more of the outwardly biased drag pistons 43 engage the wall of the borehole, however the stabilizer assembly 14 can be tilted somewhat because of the diametrical clearance provided when the pistons 44 are in their retracted positions. During downward movement the drag of a helical side surface 72 of a blade 29 against the borehole wall exerts clockwise torque which maintains the housing 30 in the orientation where the buttons 44 are retracted as shown in FIG. 7. If a bend angle has been established by operation of the bent housing assembly 13, the ability of the stabilizer 14 to tilt in its undergage condition allows full utilization of the bend angle in influencing the path of the drill bit 15.

When a bend angle is being established in the bent housing apparatus 13, which involves rotation of the drill string to the right, the spring-loaded buttons 43 provide frictional restraint which resists rotation of the housing of the assembly 13. After some degree of relative rotation, the stabilizer mandrel 20 also will be rotated to the right. Relatively speaking, the housing 30 is rotated counter-clockwise through the angle $\theta$, permitted by the excess width of the spline grooves 36, to the orientation shown in FIG. 3. This positions the outer surfaces 56 on the mandrel 20 behind the pistons 44 as shown in FIGS. 5 and 6 and causes momentary extension thereof. However, as soon as sliding drilling is commenced, the housing 30 rotates clockwise relative to the mandrel 20 due to engagement of an edge 72 with the well bore wall, which causes the flats 55 to be positioned behind the buttons 44. In addition, reactive torque as a result of operation of the motor 12 also tends to produce counter-clockwise rotation of the housing 30. Thus, the buttons 44 are shifted inward to their undergage positions by the springs 54. Again, this permits a bend angle that has been established in the tool 13 to be fully effective in influencing the path of the drill bit 15. Any time that the stabilizer 14 is moved upward in the borehole, the inclined side walls 72 do not tend to cause rotation of the housing 30, so that the pistons 44 can remain on the flats 55 and cause the stabilizer to be remain undergage. The feature is particularly useful when the drill string is being withdrawn from the well.

It will be recognized that the inclined blade surfaces 72 induce a clockwise rotation of the housing 30 and retraction of the buttons 44 only in the sliding drilling mode, so that where a bend angle is being used the bit 15 is not subjected to excessive side loads which can cause the motor 12 to stall. If a directional drilling procedure is used where rotation of the drill spring is superimposed over that of the motor 12, the stabilizer 14 automatically assumes its full gage condition because the housing 30 will be rotated counter-clockwise relative to the mandrel 20 to the orientation shown in FIG. 3. In this position the buttons 44 are cammed outward from the flat surfaces 55 onto the larger diameter surfaces 56 of the mandrel 21 as the housing 30 rotates relative to the mandrel 20 so that the stabilizer assembly 14 is full-gage.

The present invention finds particular application in various drilling procedures. Where the bend assembly 13 is straight and the pipe string 10, 11 is being rotated, the stabilizer 14 becomes full gage to center the bit 15 in the borehole. When the assembly 13 is adjusted to provided a bend angle and sliding drilling is being carried out, the stabilizer 14 automatically assumes it undergage condition for more accurate control over angle build-up rate. Of course where the assembly 13 is straight during sliding drilling, the stabilizer 14 also remains undergage to provide a slightly dropping inclination angle under circumstances where this might be desirable. Finally where the assembly 13 produces a bend angle and the pipe is being rotated, the stabilizer 14 becomes full-gage. However, this later procedure can produce high cyclical stresses in the apparatus at and near the bend point which might cause damage to the downhole tools if continued over an extended period of time, and should be avoided unless a special bend assembly 13 is used.

Figure 9:
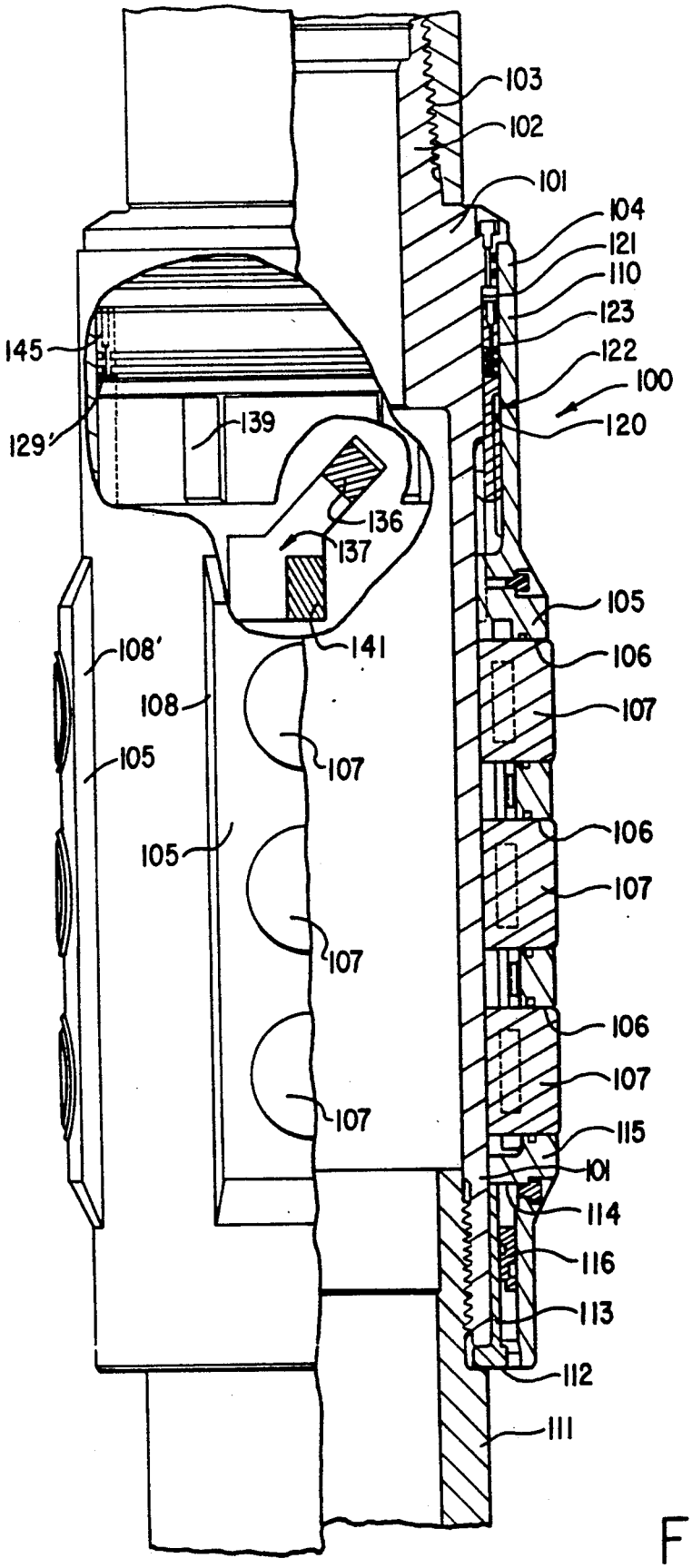
FIG. 9 is a right side-only cross sectional view, with some parts exposed in elevation, of another embodiment of the present invention.
Figure 10:
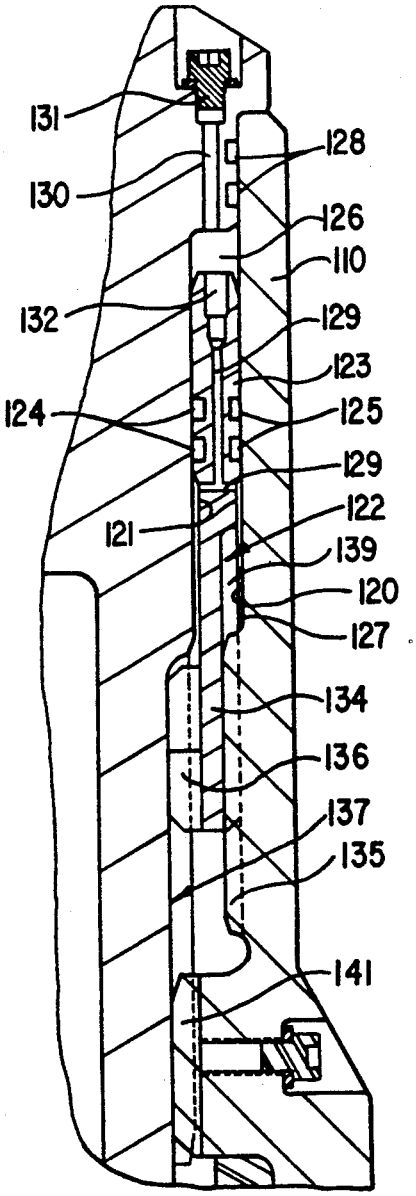
FIG. 10 is an enlarged, fragmentary cross-sectional view of a hydraulic delay piston.
Figure 11:
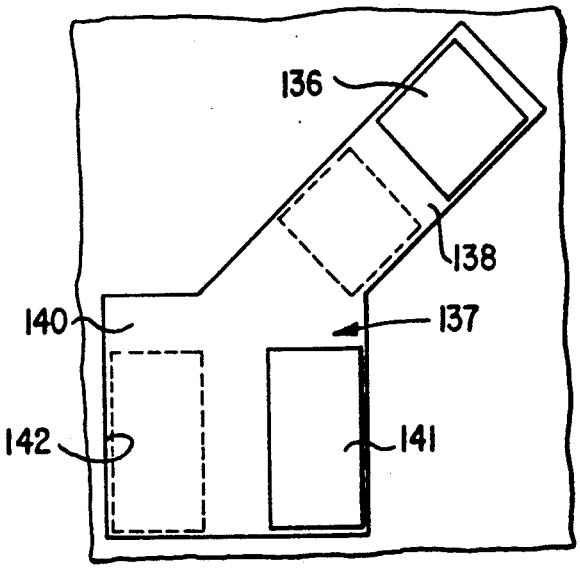
FIG. 11 is a developed plan view of the lug and channel control mechanism used in this embodiment.

The embodiment shown in FIGS. 9–11 operates as follows. Where rotation of the drill string 10, 11 is superimposed over the rotation of the power section of the downhole motor 12 in order to drill straight ahead, the stabilizer assembly 100 automatically goes to its full-gauge condition to provide a packed-hole type of drilling tool string. This is because there will be a continuous drag of at least one of the blades 105 against the low side of the borehole which produces counterclockwise torque on the sleeve member 104. Such torque forces the sleeve piston 123 upward in the chamber 122 as the lugs 136 move up the inclined segments 138 of the channels 137. The sleeve piston 123 can shift upward very slowly as hydraulic oil meters through the restrictor 132. When the ribs 141 abut against the sidewalls 142 of the channel segments 140, the sleeve member 104 will have rotated fully in the counterclockwise direction to the relative position where the buttons 107 are extended to the full gauge diameter.

When superimposed rotation is stopped and sliding drilling begins, the buttons 107 will be shifted inward to their undergage position. As mentioned above, the drill string will undergo torsional oscillations due to various factors, the amplitude of such oscillations being maximum in the vicinity of the drilling motor 12. Of course the housing of the motor 12 is connected to the mandrel of the bent housing assembly 13, and the housing of the assembly 13 is connected to the mandrel 101 so that such oscillations are transmitted to the mandrel 101. Each time the mandrel 101 turns counterclockwise and the sleeve member 104 remains stationary, the sleeve piston 123 is pulled at least partially downward as oil flows substantially freely through the check valve 145. Each time the mandrel 101 rotates clockwise, the sleeve member 104 again remaining stationary, upward movement of the sleeve piston 123 is hydraulically retarded. Thus the sleeve member 104 will be moved to its full clockwise relative position on mandrel 101, as shown in FIG. 7, where the buttons 107 are retracted. In this position the stabilizer assembly 100 is undergage and will not impede the use of a bend angle in the assembly 13 in directionally drilling the borehole.

It now will be recognized that new and improved downhole adjustable stabilizers have been disclosed which meet the objectives and have the features and advantages of the present invention. Since certain changes or modifications may be made in the disclosed embodiment without departing from the inventive concepts involved, it is the aim of the appended claims to cover all such changes and modifications that fall within the true spirit and scope of the present invention.

What is claimed is:

1. A downhole adjustable stabilizer apparatus comprising: a mandrel, sleeve means mounted on said mandrel for limited relative rotation; a plurality of radially movable members on said sleeve means, said members being movable between retracted and extended positions; and means responsive to rotation of said sleeve means relative to said mandrel in one rotational direction for enabling retraction of at least some of said members, and in the other rotational direction for causing extension of at least some of said members, said members when retracted enabling said apparatus to be tilted in a borehole.

2. The apparatus of claim 1 further including a plurality of wall-engaging members on said sleeve means; and means biasing each of said wall-engaging members outward to provide a frictional restraint to longitudinal and rotational movement of said sleeve means.

3. The apparatus of claim 1 wherein said retraction enabling means comprises planar surface means on the outer periphery of said mandrel that when located behind said radially movable members permits their inward movement to said retracted position.

4. The apparatus of claim 3 wherein said extension causing means comprises cam surfaces on the periphery of said mandrel for shifting said radially movable members outward onto a cylindrical outer surface of said mandrel.

5. The apparatus of claim 1 further including means for limiting relative rotation of said sleeve means on said mandrel, said rotation limiting means comprising splines having a first width engaging spline grooves having a second, greater width.

6. The apparatus of claim 1 wherein each of said radially movable members comprises a piston arranged to move within a radial bore in said sleeve means, and further including spring means for biasing each of said pistons inward.

7. The apparatus of claim 6 further including retainer means for limiting outward movement of each of said pistons.

8. The apparatus of claim 7 wherein said retainer means comprises a generally U-shaped member having spaced-apart legs; and groove means on opposite sides of each of said pistons adapted to receive said legs, said legs being arranged to engage said sleeve means to limit outward movement of said pistons.

9. The apparatus of claim 8 wherein said spring means comprises a leaf spring attached to said legs for providing a return bias force to said retainer means that shifts said pistons toward their retracted positions.

10. The apparatus of claim 1 including a lubricating oil chamber between said mandrel and said sleeve means; and means for compensating the oil in said chamber for changes in volume, temperature and pressure.

11. The apparatus of claim 1 further including means on said sleeve means for applying torque thereto that tends to rotate said sleeve means in said one rotational direction in response to downward movement of said apparatus in a wellbore.

12. The apparatus of claim 11 wherein said torque applying means comprises a helical surface on said sleeve means providing an edge that is adapted to slide against a borehole wall.

13. A downhole adjustable stabilizer apparatus comprising: a mandrel; a sleeve member mounted on said mandrel for limited relative rotation; at least three vertically arranged and circumferentially spaced sets of radially movable pistons on said sleeve member; means on said mandrel for supporting said pistons in extended positions in a first rotational position of said sleeve member on said mandrel; and means responsive to rotation of said sleeve member to a second rotational position on said mandrel for allowing movement of said sets of pistons to retracted positions in order to enable said stabilizer apparatus to have a substantially undergage size with respect to the diameter of a wellbore.

14. The apparatus of claim 13 further including wall-engaging drag means on said sleeve member engageable with a wellbore wall to provide frictional restraint against rotation of said sleeve member in a wellbore.

15. The apparatus of claim 14 wherein said drag means comprises wall-engaging elements vertically aligned with each of said sets of radially movable pistons; and spring means biasing each of said elements radially outward.

16. The apparatus of claim 13 wherein said means allowing movement to retracted positions comprises flat surface means on the outer periphery of said mandrel adapted to be moved into general radial alignment with each of said sets of radially movable pistons in said second rotational position.

17. The apparatus of claim 16 further including smoothly curved transition areas between the sides of each of said flat surface means and said outer periphery of said mandrel.

18. The apparatus of claim 13 further including spline and groove means for coupling said mandrel and sleeve member together, said groove means being wider than said spline means to allow said limited relative rotation.

19. The apparatus of claim 13 wherein said sleeve member has outwardly extending longitudinal blades on the outer periphery thereof, said radially movable pistons being sealingly slidable within companion radial bores through the walls of said blades; and stop means for limiting outward movement of said pistons.

20. The apparatus of claim 19 wherein said stop means includes a generally U-shaped element located between said mandrel and said sleeve member and having spaced-apart legs; and groove means on opposite sides of each of said pistons for receiving respect ones of said legs so that outward movement of said pistons causes said legs to abut an inner wall of the sleeve member.

21. The apparatus of claim 20 further including spring means for biasing said stop means inwardly to insure inward movement of said pistons in said second rotational position.

22. The apparatus of claim 11 further including external means on said sleeve member for causing rotation thereof of said second rotational position when said apparatus is moved downward in a wellbore.

23. The apparatus of claim 22 when said external means comprises a surface to one side of each of said blades that is inclined with respect to the longitudinal axis of said sleeve member so as to provide a torque thereon due to engagement of said surface with the wellbore wall.

24. A downhole adjustable stabilizer apparatus comprising; a mandrel; sleeve means mounted on said mandrel for limited relative rotation; a plurality of radially movable members on said sleeve means, said members being movable between retracted and extended positions; means responsive to relative rotation of said mandrel and said sleeve means in one rotational direction for enabling retraction of said members and in the other rotation direction for causing extension of said members; and means for restraining relative rotation of said mandrel and said sleeve means in said other rotation direction.

25. The apparatus of claim 24 when said restraining means includes hydraulically operable means between said mandrel and said sleeve means; means for converting relative rotation of said mandrel and said sleeve means to longitudinal movement of said hydraulically operable means; and means for delaying movement of said hydraulically operable means in one longitudinal direction.

26. The apparatus of claim 25 further including means disabling said delaying means during movement of said hydraulically operable means in the opposite longitudinal direction.

27. The apparatus of claim 25 wherein said hydraulically operable means includes a sleeve piston mounted in an oil-filled chamber between said mandrel and sleeve means, said sleeve piston having a flow passage therethrough; said delaying means including restriction means in said flow passage for metering the flow of oil through said sleeve piston at a controlled rate.

28. The apparatus of claim 26 wherein said disabling means includes additional passage means in said sleeve piston; and check valve means for permitting substantially free flow of oil through said additional passage means during longitudinal movement of said hydraulically operable means in the opposite longitudinal direction.

29. The apparatus of claim 25 wherein said converting means includes slidable means for preventing rotation of said hydraulically operable means relative to said sleeve means; and axial cam means on said hydraulically operable means and said mandrel for moving said hydraulically operable means in one longitudinal direction along said sleeve means in response to relative rotation of said mandrel and said sleeve means in one direction and in the opposite longitudinal direction in response to relative rotation of said mandrel and said sleeve means in the other direction.

30. The apparatus of claim 24 further including means on said sleeve means and said mandrel for limiting relative rotation to a predetermined angle.

31. The apparatus of claim 29 wherein said axial cam means includes lug means on said hydraulically operable means and channel means on said mandrel, said channel means including an inclined helical segment that receives said lug means.

32. Downhole adjustable stabilizer apparatus comprising: a mandrel, sleeve means mounted for limited rotational movement on said mandrel; a plurality of button means mounted on said sleeve means and arranged for radial movement between extended and retracted positions in response to said rotational movement; means forming an annular oil-filled chamber between said mandrel and said sleeve means; piston means mounted for longitudinal movement in said chamber; means for co-rotatively coupling said piston means of said sleeve means; cam means for converting rotation of said mandrel relative said sleeve means to longitudinal movement of said piston means; and means for restraining movement of said piston means in one longitudinal direction in said chamber to correspondingly restraint relative rotation of said mandrel in the direction that causes extension of said button means.

33. The apparatus of claim 32 wherein said restraining means includes restricted oil passage means extending between opposite sides of said piston means so that said piston can move only slowly in said one longitudinal direction.

34. The apparatus of claim 33 including additional passage means through said piston means; and check valve means for permitting relatively free flow of oil therethrough during movement of said piston means in the opposite longitudinal direction.

35. The apparatus of claim 32 wherein said cam means includes a follower on said piston means that engages a helically inclined channel in said mandrel so that rotation of said mandrel relative to said sleeve means in one rotational direction shifts said piston in said one longitudinal direction, and relative rotation in the opposite direction shifts said piston in the opposite longitudinal direction.

36. The apparatus of claim 35 further including means on said sleeve means and mandrel for stopping relative rotation of said mandrel and sleeve means at selected angular position.

37. A method enabling improved control over the inclination of a borehole being drilled with a bit suspended in the borehole on a drill string, comprising the steps of: positioning a stabilizer in the drill string near the bit, said stabilizer having an undergage condition and full gage condition; in response to downward sliding of the drill string during drilling, causing said stabilizer to assume its undergage condition; and in response to rotation of the drill string during drilling, causing said stabilizer to assume its full gage condition.

38. The method of claim 37 including the further step of positioning a fluidoperated motor in the drill string above said stabilizer; and operating said motor by fluid circulation to cause rotation of said bit.

39. A method for maintaining a downhole adjustable stabilizer undergauge during sliding drilling with a drill bit that is driven by a downhole motor, said stabilizer having a mandrel and a sleeve that carries a plurality of buttons which are shifted between retracted, undergauge positions and extended, full-gauge positions in response to rotation of said mandrel relative to said sleeve in opposite hand directions, comprising the steps of: allowing substantially free relative rotation in that one of said directions which results in shifting of said buttons to said retracted positions; and restraining relative rotation in the other direction.

40. The method of claim 39 including the further step of limiting relative rotation of said mandrel and sleeve to that angle of relative rotation which causes complete retraction and extension of said buttons.

* * * * *